US009421751B2

(12) United States Patent
Karp et al.

(10) Patent No.: US 9,421,751 B2
(45) Date of Patent: Aug. 23, 2016

(54) DIRECT INKJET IMAGING LITHOGRAPHIC PLATES, METHODS FOR IMAGING AND PRE-PRESS TREATMENT

(75) Inventors: Michael Karp, Petah Tikva (IL); Aida Porat, Kibbutz Hanita (IL); Sergei Bonder, Haifa (IL); Zeev Savion, Tel Aviv (IL); Boris Brant, Shlomi (IL)

(73) Assignee: VIM-TECHNOLOGIES LTD, Kibbutz Hanita (IL)

( * ) Notice: Subject to any disclaimer, the term of this patent is extended or adjusted under 35 U.S.C. 154(b) by 868 days.

(21) Appl. No.: 13/511,096

(22) PCT Filed: Nov. 17, 2010 (Under 37 CFR 1.47)

(86) PCT No.: PCT/IL2010/000958

§ 371 (c)(1), (2), (4) Date: May 21, 2012

(87) PCT Pub. No.: WO2011/061738

PCT Pub. Date: May 26, 2011

(65) Prior Publication Data

US 2013/0027462 A1 Jan. 31, 2013

Related U.S. Application Data

(63) Continuation-in-part of application No. 12/900,058, filed on Oct. 7, 2010, now abandoned.

(60) Provisional application No. 61/263,501, filed on Nov. 23, 2009.

(51) Int. Cl.

| | |
|---|---|
| ***B41J 2/21*** | (2006.01) |
| ***B41C 1/10*** | (2006.01) |
| ***B41J 2/005*** | (2006.01) |

(52) U.S. Cl.

CPC ..... *B41C 1/1066* (2013.01); *B41J 2/0057* (2013.01); *B41J 2/2107* (2013.01)

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00

USPC ..... 347/100, 95, 101, 96, 102, 105; 106/31.6, 31.27, 31.13; 523/160, 161

See application file for complete search history.

(56) References Cited

U.S. PATENT DOCUMENTS

| | | | |
|---|---|---|---|
| 3,068,202 | A | 12/1962 | Burg |
| 3,234,873 | A | 2/1966 | Miller |

(Continued)

FOREIGN PATENT DOCUMENTS

| | | | |
|---|---|---|---|
| CA | 2 393 320 | A1 | 7/2002 |
| DE | 3911934 | A1 | 10/1990 |

(Continued)

OTHER PUBLICATIONS

Nissan Chemical American Corporation, SNOWTEX.

(Continued)

*Primary Examiner* — Manish S Shah

(74) *Attorney, Agent, or Firm* — Morgan, Lewis & Bockius LLP

(57) ABSTRACT

Wet lithographic printing members for imaging by an inkjet printer using pigment-based aqueous ink and method for calibrating the amount of the inkjet ink to be injected in solid areas of an image are disclosed. An exemplary printing member can comprises a base substrate and a top hydrophilic coating layer having a thickness in the range of 2 to 10 microns above the base substrate. A volume of less than 10 nl/mm2 of inkjet ink is used in order to image areas in which the image is solid. Areas of the top hydrophilic coating layer, which are imagewise covered by aqueous pigmented inkjet ink, become hydrophobic. In some embodiments after imaging, the surface of the imaged printing member can be treated with acidic colloidal silica solution. Exemplary treatment can comprise wiping the surface of the imaged printing member with the acidic colloidal silica solution.

11 Claims, 2 Drawing Sheets

(56) References Cited

U.S. PATENT DOCUMENTS

| | | | | |
|---|---|---|---|---|
| 3,575,925 | A | 4/1971 | Skoultchi | |
| 3,850,649 | A | 11/1974 | Buerkley et al. | |
| 4,003,312 | A | 1/1977 | Gunther | |
| 4,562,140 | A | 12/1985 | Kohmura et al. | |
| 4,833,486 | A | 5/1989 | Zerillo | |
| 5,165,345 | A | 11/1992 | Lewis et al. | |
| 5,249,525 | A | 10/1993 | Lewis | |
| 5,454,318 | A | 10/1995 | Hirt et al. | |
| 5,501,150 | A | 3/1996 | Leenders et al. | |
| 5,525,455 | A | 6/1996 | Kurokawa et al. | |
| 5,570,120 | A * | 10/1996 | Sakaki et al. | 347/105 |
| 5,639,586 | A * | 6/1997 | Hauquier et al. | 101/457 |
| 5,738,013 | A | 4/1998 | Kellett | |
| 5,750,314 | A | 5/1998 | Fromson et al. | |
| 5,820,932 | A | 10/1998 | Hallman et al. | |
| 5,900,345 | A | 5/1999 | Platzer et al. | |
| 5,970,873 | A | 10/1999 | DeBoer et al. | |
| 6,040,115 | A | 3/2000 | Bailey et al. | |
| 6,114,094 | A | 9/2000 | Ishiguro et al. | |
| 6,131,514 | A | 10/2000 | Simons | |
| 6,152,037 | A * | 11/2000 | Ishii et al. | 101/466 |
| 6,184,267 | B1 | 2/2001 | Kato et al. | |
| 6,231,988 | B1 * | 5/2001 | Kato et al. | 428/447 |
| 6,251,523 | B1 | 6/2001 | Takahashi et al. | |
| 6,416,175 | B2 | 7/2002 | Furukawa et al. | |
| 6,455,132 | B1 | 9/2002 | Aurenty et al. | |
| 6,479,203 | B1 | 11/2002 | Tashiro et al. | |
| 6,500,524 | B2 | 12/2002 | Moriya | |
| 6,506,479 | B1 | 1/2003 | Horiuchi | |
| 6,523,473 | B2 | 2/2003 | Loccufier et al. | |
| 6,538,772 | B1 | 3/2003 | Choulet | |
| 6,620,469 | B2 | 9/2003 | Totani et al. | |
| 6,635,320 | B2 | 10/2003 | Wakata et al. | |
| 6,671,070 | B1 | 12/2003 | Schildermans et al. | |
| 6,691,618 | B2 | 2/2004 | Deutsch et al. | |
| 6,742,886 | B1 | 6/2004 | Ray | |
| 6,748,861 | B1 | 6/2004 | Riepenhoff et al. | |
| 6,758,140 | B1 | 7/2004 | Szumla et al. | |
| 6,772,687 | B2 | 8/2004 | Damme et al. | |
| 6,783,228 | B2 | 8/2004 | Szumla et al. | |
| 6,783,836 | B2 * | 8/2004 | Bennett et al. | 101/453 |
| 6,815,075 | B2 | 11/2004 | Kasai et al. | |
| 6,869,743 | B1 | 3/2005 | Suzuki et al. | |
| 6,906,019 | B2 | 6/2005 | Nitzan et al. | |
| 6,981,446 | B2 | 1/2006 | Ray et al. | |
| 7,044,053 | B2 | 5/2006 | Figov et al. | |
| 7,056,643 | B2 | 6/2006 | Ray et al. | |
| 7,089,857 | B2 | 8/2006 | Nouel | |
| 7,125,448 | B2 | 10/2006 | Martin et al. | |
| 7,134,395 | B2 | 11/2006 | Riley et al. | |
| 7,223,453 | B2 | 5/2007 | Takashima et al. | |
| 7,261,396 | B2 * | 8/2007 | Hawkins et al. | 347/74 |
| 7,342,685 | B2 | 3/2008 | Minnebo et al. | |
| 7,364,773 | B2 | 4/2008 | Burch et al. | |
| 7,399,507 | B2 | 7/2008 | Bhatt et al. | |
| 7,608,388 | B2 | 10/2009 | Deutsch et al. | |
| 7,615,266 | B2 | 11/2009 | Kinoshita et al. | |
| 2002/0014175 | A1 | 2/2002 | Loccufier et al. | |
| 2002/0023566 | A1 * | 2/2002 | Nakazawa et al. | 101/463.1 |
| 2002/0034613 | A1 | 3/2002 | Liu et al. | |
| 2002/0054980 | A1 | 5/2002 | Moriya | |
| 2002/0126189 | A1 | 9/2002 | Gloster | |
| 2002/0171730 | A1 * | 11/2002 | Nakahara et al. | 347/105 |
| 2003/0010240 | A1 * | 1/2003 | Verschueren et al. | 101/450.1 |
| 2003/0072925 | A1 | 4/2003 | Kiyama et al. | |
| 2003/0159607 | A1 | 8/2003 | Nitzan et al. | |
| 2004/0038152 | A1 | 2/2004 | Goodin et al. | |
| 2004/0051768 | A1 | 3/2004 | DeBoer et al. | |
| 2004/0154489 | A1 | 8/2004 | Deutsch et al. | |
| 2005/0134667 | A1 * | 6/2005 | Campbell et al. | 347/105 |
| 2005/0235854 | A1 | 10/2005 | Vermeersch et al. | |
| 2005/0270357 | A1 * | 12/2005 | Kawai | 347/105 |
| 2006/0107859 | A1 | 5/2006 | Sampei | |
| 2006/0144271 | A1 * | 7/2006 | Suda et al. | 101/453 |
| 2006/0223005 | A1 | 10/2006 | Hotta | |
| 2006/0223006 | A1 | 10/2006 | Shimada et al. | |
| 2006/0281027 | A1 | 12/2006 | Makino et al. | |
| 2008/0233315 | A1 | 9/2008 | Aoshima et al. | |
| 2008/0268160 | A1 | 10/2008 | Andriessen | |
| 2009/0022910 | A1 | 1/2009 | Teramae | |
| 2009/0064884 | A1 | 3/2009 | Hook et al. | |
| 2009/0123741 | A1 * | 5/2009 | Bhatt et al. | 428/337 |
| 2009/0223394 | A1 | 9/2009 | Bangel et al. | |

FOREIGN PATENT DOCUMENTS

| | | | |
|---|---|---|---|
| EP | 0 503 621 | A1 | 9/1992 |
| EP | 0 533 168 | A1 | 3/1993 |
| EP | 0 723 195 | A1 | 7/1996 |
| EP | 1 243 411 | A1 | 9/2002 |
| EP | 1 398 150 | A1 | 3/2004 |
| EP | 1 595 922 | A2 | 11/2005 |
| EP | 1 661 697 | A1 | 5/2006 |
| EP | 1 985 445 | A1 | 10/2008 |
| GB | 9649375 | | 7/1964 |
| GB | 1431462 | | 4/1976 |
| JP | 56105960 | A | 8/1981 |
| JP | 5338372 | A | 12/1993 |
| JP | 10024549 | A | 1/1998 |
| JP | 10296945 | A | 11/1998 |
| JP | 11091259 | A | 4/1999 |
| JP | 2004299167 | A | 10/2004 |
| JP | 2005313490 | A | 11/2005 |
| WO | 00/37254 | | 6/2000 |
| WO | 01/34394 | A1 | 5/2001 |
| WO | 01/49506 | A2 | 7/2001 |
| WO | 02/078869 | A1 | 10/2002 |
| WO | 2004/052647 | A2 | 6/2004 |
| WO | 2007/045607 | A1 | 4/2007 |
| WO | 2009/025809 | A1 | 2/2009 |
| WO | 2009/063024 | A1 | 5/2009 |

OTHER PUBLICATIONS

International Search Report issued for PCT/IL2010/000958 on Apr. 14, 2011.

* cited by examiner

DIRECT INKJET IMAGING LITHOGRAPHIC PLATES, METHODS FOR IMAGING AND PRE-PRESS TREATMENT

CROSS-REFERENCE TO RELATED APPLICATIONS

This application is being filed with the United States Patent Office under 35 U.S.C. 371 as a national stage application of International Application number PCT/IL2010/000958 filed in the Israeli Receiving Office on Nov. 17, 2010, which application claims the benefit of the filing dates of the United States Non-Provisional Application for Patent filed on Oct. 7, 2010 and assigned Ser. No. 12/900,058, which application claims priority to the following United States Provisional Applications for Patent, and to which the PCT application also claims priority to: United States Provisional Application for Patent that was filed on Nov. 23, 2009, bearing the title of "DIRECT INKJET IMAGING LITHOGRAPHIC PLATES AND METHODS FOR IMAGING THE PLATES" and assigned Ser. No. 61/263,501, all of which are herein incorporated by reference.

BACKGROUND

The embodiments presented in this disclosure generally relate to Lithographic printing and more particularly to imaging of wet Lithographic printing plates and pre-press handling of inkjet imaged wet Lithographic printing plates.

Lithographic printing is based on the principle that oil and water do not mix. A lithographic printing plate has non-image areas which absorb water (hydrophilic areas) and image areas which repel water (hydrophobic areas). For a wet offset lithographic printing, the plate is first dampened water so that the ink is applied to the wetted printing plate to form the image. The ink, which is inherently oily, is rejected by the wet areas and adheres to the image areas. The ink from the inked printing plate is then transferred or "offset" to a rubber blanket. Next, the image on the blanket is transferred to the substrate to produce the printed product.

Common polyester wet lithographic plates have hydrophilic top layer that is formed by organic hydrophilic polymer and inorganic particles of micron and submicron sizes. Usually such layer has relative low thickness: some printing plate with organic hydrophilic layer, such as polyester silver plates, have hydrophilic layer with a thickness under 2-3 micron. A common imaging process of a polyester wet lithographic plates having relative low thickness hydrophilic top layer, involves unhealthy chemicals and expensive imaging devices, such as computer-to-plate (CTP) devices.

SUMMARY OF THE DESCRIPTION

Another process of imaging wet lithographic plate having relative low thickness hydrophilic top layer is direct imaging by inkjet printers. In order to image the thin lithographic layer the inkjet printers as well as the inks are specifically designed for this use. The inks are usually solvent-based or wax-based. Such inks are considerably more expensive and are not environment friendly.

In order to deliver environment friendly imaging process, there are wet lithographic printing plate that can be imaged by water based inkjet printers. However, in order to deliver the required density and image quality the hydrophilic layer of the printing plate has to be thick, above 10 microns, for example.

Some of the wet lithographic printing plate that can be imaged by water based inkjet printers may have small dots, 100 micron to 5 mm for example, in non imaged areas that are oleophilic. On the press machine the ink can be adhered to those small dots and be transferred to the paper and reduces the quality of the printed copy.

The above-described deficiencies of imaging wet lithographic printing plate by inkjet printers do not limit the scope of the inventive concepts of the present disclosure in any manner. The deficiencies are presented for illustration only.

We found that the press results when using lithographic printing plates with thick hydrophilic layer have lower quality than the quality of the results of press in which lithographic printing plates with hydrophilic thin layer are used. In addition we found that the thickness of the hydrophilic layer has inverse effect on the performance of a wet lithographic printing plate, the thicker the hydrophilic layer the worse plate performance. In printing plate in which the hydrophilic layer is too thick, scumming occurs (non-image area of a lithographic plate accepts ink).

Embodiments of the present disclosure provide novel systems and methods that enable imaging on demand at the print shop in a simple chemistry-free process using inkjet printers, wherein the substrate of the printing plate can be polyester or aluminum sheets or rolls, for example and the hydrophilic layer is thin, in the range of 2-6 micron, for example.

Exemplary embodiments use standard inkjet printers with standard water-based pigment ink, for imaging the exemplary wet lithographic printing plate; consequently the imaging process is environment friendly and does not enquire chemical post-processing. The exemplary plate can comprise a relative thin hydrophilic top layer that is capable of receipting water-based inkjet ink during imaging on an inkjet printer without smearing and any other effects that deteriorating the image. In some embodiments the inkjet image can be fixed with post-imaging heating. During the wet offset printing in the offset press machine the imaged area will reject the water, while the rest of the hydrophilic coating layer (without the image) provides good hydrophilic performance for adhering the ink repelling liquid (water, for example).

A novel process is disclosed for calibrating the inkjet printer in order to image a wet lithographic member having a thin hydrophilic coating. Although the inkjet printer prints over the wet lithographic member, the calibration is based on the quality of the copies of the image received at the end of the wet offset printing process and not the quality of the inkjet image on the printing member. Exemplary adjustment process of the inkjet printer may take into consideration few parameters. One parameter can be the coverage area of the inkjet drop and not the density of the inkjet image, because the imaged covered area converts the hydrophilic surface of the hydrophilic coating layer into hydrophobic area. A second parameter can be the run length, the number of high quality printed copies from an imaged printing plate. The quality of the wet press image is good as long as the inkjet image over the printing plate is stable and not be removed or washed from plate. If it will be removed by water (dampening solution) or by offset ink, this area will return to be hydrophilic and the printing quality of the copy will deteriorated. In some embodiments, calibrating an inkjet printer can be done by calibrating a raster image processor (RIP) that is associated with the inkjet printer.

We found that for proper imaging of a wet-lithographic-printing member by an inkjet printer with water based pigment ink, imaging should be performed at such manner (or conditions) that the inkjet ink quantity per printed surface will be above 2 and under 10 nl/mm$^2$. It should be taken into account that printing on plate is performed with a single ink color, cyan for example. This value is much bellow of the ink amount usually used for water-based-pigmented-inkjet printers with conventional media. In some cases we found that good performance of an imaged printing plate can be achieved by volume of water-based-pigmented-inkjet ink in the range of 10% of the volume that is usually used in order to print a common water-based-pigmented-inkjet paper, such as photo-paper for example.

We also found that a pre-press treatment of an imaged printing plate improves the inkjet imaged printing plate performance providing sharper dots and clean up unwanted contaminations on non imaged areas of plate. An exemplary pre-press treatment can include applying or wiping, before printing on offset press, the imaged plate surface with solution of acidic colloidal silica.

The foregoing summary is not intended to summarize each potential embodiment or every aspect of the present invention, and other features and advantages of the present invention will become apparent upon reading the following detailed description of the embodiments with the accompanying drawings and appended claims.

Furthermore, although specific exemplary embodiments are described in detail to illustrate the inventive concepts to a person skilled in the art, such embodiments can be modified to various modifications and alternative forms. Accordingly, the figures and written description are not intended to limit the scope of the inventive concepts in any manner.

BRIEF DESCRIPTION OF THE DRAWINGS

Exemplary embodiments of the present disclosure will be understood and appreciated more fully from the following detailed description, taken in conjunction with the drawings in which.

Figure 1:
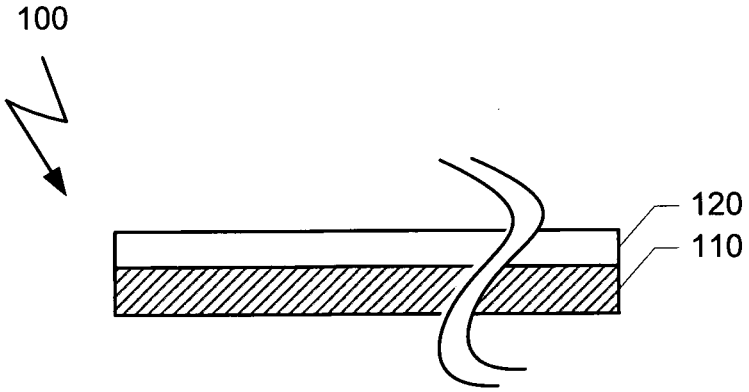
FIG. 1 is an illustration of a printing plate according to some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF EXEMPLARY EMBODIMENTS

In the following detailed description, numerous specific details are set forth in order to provide a thorough understanding of the invention. However it will be understood by those of ordinary skill in the art that the embodiments of present invention may be practiced without these specific details. In other instances, well-known methods, procedures and components have not been described in detail so as not to obscure the present invention.

Embodiments of the present invention are directed to a printing member and a method of imaging a printing member by direct imaging using inkjet printing. The imaging of the printing member may be performed by selectively depositing inkjet ink, such as water-based pigmented ink from a standard inkjet printer.

According to some embodiments of the present invention, the imaged printing member may be a lithographic printing plate suitable for conventional wet printing systems. According to other embodiments, the printing member may be applied directly onto a lithograph printing system. It should be noted that the terms "printing member" and "printing plate" are used interchangeably throughout the specification and claims and refer to any type of printing member or surface capable of recording an image defined by regions exhibiting differential affinities for ink of the press machine. The term "hydrophilic" is used throughout the specification and claims to describe the affinity of a surface for a fluid to prevent ink from adhering thereto. Such fluids may include water and other aqueous and non-aqueous dampening liquids. The term "oleophilic" is used throughout the specification and claims to describe the affinity of a surface for ink of the press machine to adhere thereto.

FIG. 1, illustrates a side view of a printing plate according to some embodiments of the present description. A printing plate 100 may include a substrate 110 and a hydrophilic coating layer 120. According to some embodiments, substrate 110 may be aluminum, for example grained aluminum. Alternatively, substrate 110 may include a self supporting polymer such as polyester (PET). Optionally, a primer layer (not shown) may be added between substrate 110 and the hydrophilic coating 120 or special substrate pretreatment may be implemented for allowing adhesion of hydrophilic layer 120 to the substrate 110. The primer layer may include polyurethane, acrylic resin, polyvinyl acetat, polyvinyl butyral, polyvinyl alcohol, polyacrylic acid, terpolymer of polyvinyl alcohol, polyvinyl acetate and polyvinyl butyral and any combination thereof, silicates like sodium silicate. The primer layer may also include a matting agent, such as amorphous silica, alumina or kaolin.

Exemplary hydrophilic coating layer 120 can be hydrophilic polymer (polyvinyl alcohol, for example), with inorganic filler (colloid and/or amorphous silica, for example), optionally crosslinkers, surfactants, etc. can be added to the formula of hydrophilic coating layer 120. The thickness of hydrophilic coating layer 120 can be in the range of 2-10 micron.

Figure 2:
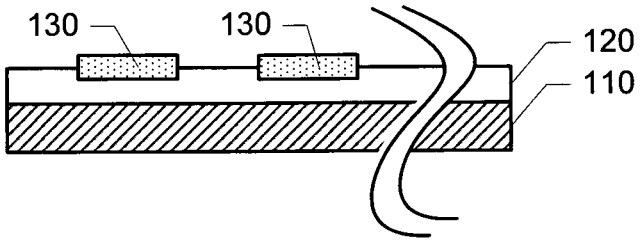
FIG. 2 is an illustration of an imaged printing plate according to some embodiments of the present invention.

FIG. 2, illustrates a side view of the printing plate 100 after being imaged by an inkjet printer using water-based-pigment-inkjet ink. Areas 130 represent a portion of the imaged area. Imaging of the printing plate 100 can be done by Epson Stylus Pro 4880 with water-based-pigment-inkjet Cyan ink, for example. In such embodiment, the imaged area 130 comprises the cyan pigments other embodiments may use Epson Stylus Pro 7900 with Vivid Magenta ink, for example. Areas 130 over the hydrophilic coating layer 120 that comprises the pigments of the inkjet ink become oleophilic. The rest of the area of layer 120 which is not covered by the cyan pigments remains hydrophilic. The imaging area can be done with inkjet ink volume less than 10 nl per a mm square of areas in which the image is solid. A solid area of a certain separation (cyan or yellow, for example) of the wet lithographic process is an area which has to be 100% covered after the press by the separation ink.

Table 1, below represents an exemplary formulation of hydrophilic coating compound. Coating a substrate with the below formulation using quantity of 3 to 15 g/sq.m can deliver a hydrophilic top layer with thickness in the range of 2-10 micron, for example.

TABLE 1

Example of hydrophilic coating formulation.

| Weight % | Ingredients of hydrophilic coating |
|---|---|
| 24.6 | Isopropyl Alcohol (IPA) |
| 0.20 | Sodium chloride |
| 0.15 | Wetting agent, sold under the trade name of Hydropalat 120 by Cognis, Germany. |
| 27.5 | 10% water solution of polyvinyl alcohol sold under the trade name of Cevol 523 by Celanese, Dallas, USA. (hydrophilic polymer) |
| 36.2 | Colloidal silica, sold under the trade name of Snowtex OUP by Nissan Chemical America Corporation, USA. (colloidal silica) |
| 0.36 | Amorphous silicon dioxide agent, sold under the trade name of Syloid C803 by Grace Davison, Worms, Germany. (amorphous silica) |
| 0.25 | Cross-linking agent, sold under the trade name of Bacote 20 by MEL Chemicals, England. (cross-linking agent) |
| b.t.w | Water |

The components, presented above in table 1, can be mixed and applied to a aluminum substrate, 150 micron of Hydro, Oslo, Norway. The aluminum was treated with a primer produced by Hanita Coating using a Roll Formed Chrome Plated FT#35 of Buschman Corporation, Ohio, USA. The coated film was than dried at 130° C. for 2 minutes.

The hydrophilic coating can be imaged by selectively applying an inkjet ink sold under the trade name T5652 UltraChrome K3 cyan inkjet ink by Epson using Epson Stylus 4880 inkjet printer, Wasatch SoftRIP SP.

Figure 3:
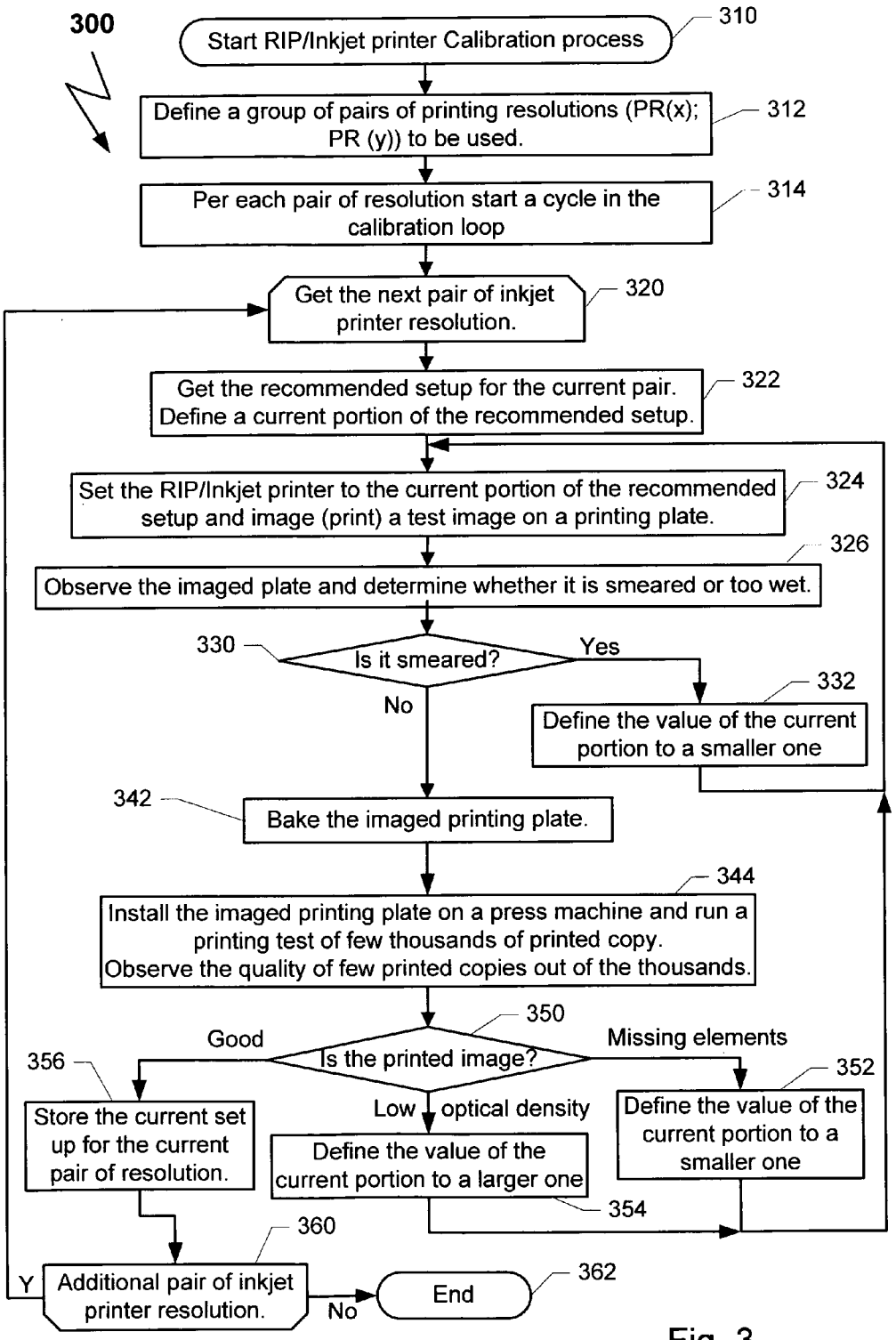
FIG. 3 is an illustration of a flowchart with relevant acts of an exemplary RIP/Inkjet printer calibration process.

FIG. 3 illustrates a flowchart with relevant acts of an exemplary RIP/Inkjet printer calibration process. Such an exemplary process can be used for calibrating a RIP such as Wasatch SoftRIP SP (a trademark of WASATCH COMPUTER TECHNOLOGY USA), for example, an Inkjet printer Epson Stylus Pro 4880 (a trademark of Epson America, Inc", for example. An exemplary inkjet ink can be T5652 UltraChrome K3 cyan inkjet ink by Epson America, Inc. Process 300 can be done during an installation of a RIP and/or an inkjet printer at a site, and/or replacing the type of the inkjet ink, and/or using a new type of printing member having an hydrophilic top layer.

Process 300 can be initiated 310 after loading an exemplary Wasatch SoftRIP SP RIP system to a computer that controls an inkjet printer such as but not limited to Epson Stylus Pro 4880. At act 312 a group of pairs of inkjet printing resolutions, which are needed at the site, can be defined PR(x);PR(y). Wherein PR(x) refers to resolution in dots per inch (DPI) in the direction of the inkjet-printer head and PR(y) refers to resolution in DPI in the direction of the media feed. Exemplary pairs can be 1440×720 DPI; 720×720 DPI; and 1440×1440 DPI, etc. After defining the required group of pairs of resolution a loop can be initiated 314. Each cycle in the loop, 320 to 360, can be implemented per each pair of resolutions. The loop is implemented for calculating the appropriate setup of the RIP/Inkjet printer to the printing plate having a hydrophilic top coating layer. The setup may include two parameters: DV and IR pair each pair of resolutions. Wherein DV represents inkjet ink drop volume in picoliters; and IR represents a factor of ink reduction, % of actually jetted drops relative to maximum available drops at the same resolution. Recommended values of DV and/or IR can be found in the manual of the Inkjet Printer and/or the RIP.

At step 320 the next pair of resolution PR(x);PR(y) is handled. The recommended values of DV and IR for printing on a common inkjet papers, at the current pair of resolution can be obtained 322 from a default setting table from the RIP manual or user interface. A portion of the recommended values of DV or IR can be selected. A recommended portion to start with can be 30% or even less of one of those recommended parameters.

After determining the portion of the values of DV and/or IR the applied inkjet-ink quantity (IPS) per each square unit, a square mm for example, can be calculated for example by:

$$IPS\ [\text{nl/sq.mm}]=PR(X)\times PR(Y)\times DV\times IR:(25.4^2\times 10^5)$$

Wherein:

IPS represents the inkjet printing density, the amount of wet inkjet ink in nanoliters (nl), supplied for covering of 1 sq. mm of printing member surface.

If the calculated IPS is in a desired range, 2-10 nl, for example a test image over the printing plate having the hydrophilic top layer can be printed 324 by the inkjet printer. An exemplary test image should contain solid 100% area and calibration screen (mesh). If the IPS is out of the desired range, then a new portion can be defined.

After imaging the printing plate by the inkjet printer, the printed image can be observed 326 and a decision can be made whether the image is wet or smeared and whether the solid 100% image areas a fully covered with ink. An image may be considered as smeared if 95% screen is blocked, for example. If yes, then a new portion of DV and/or IR is defined 332. The new portion can be smaller than the previous one and method 300 returns to act 324. The differences between consecutive values of the portions can decreased after each inkjet printing.

If 330 the printed image over the printing plate is not smeared, then a baking stage can be executed. The imaged plate can be baked 342 for 2-10 min at 100-180° C., for example. There are some exemplary printing plates that do not need the baking process. At this point the imaged printing plate is ready to be tested over a press machine. The ready printing plate is installed 344 in a press machine and a few thousands of printed copies are printed by the press machine using the ready imaged-printing plate. The number of copies can be few thousands, 5-25 thousands for example, depending on the printing press conditions and the type of the printing plate.

The quality of the printed image in few samples of printing copies, from near the top end of the printed stack, is examined 344 and a decision is made 350 on the quality of the copies that were printed near the end of the run. If 350 solid areas with missing information, missing elements exist in the printed copies, it can reflects that the IPS that was used for printing the imaged-printing plate was too large. Then, a smaller value of DV or IR than the one that was previously used should be loaded to the RIP and method 300 returns to act 324.

If 350 solid areas (full coverage) in the printed copies are uniform but have lower optical density than an expected range, it can reflect that the IPS that was used to print the imaged-printing plate, by the inkjet printer, was not high enough. Then, a larger value of DV or IR than the one that was previously used can be selected and method 300 returns to act 324. Expected optical density values of solid areas can be in the range of 1.1-2.0, a prefer range can be 1.2-1.7, depending on the paper type, for example.

If 350 the quality of the printed image is good, there are no missing information, and the density of the printed copy is in the expected range then resulting combination of PR(x), PR(y), DV, and IR are stored 356 at a permanent storage device (a disc for example) of the computer that controls the inkjet printer as the calibrated set up for the combination of the RIP/Inkjet printer, the inkjet ink, the pair of resolution and the type of the printing plate. Those values can be used when a similar printing plate with top hydrophilic layer is printed by the same RIP/Inkjet printer in the same pair of resolution and by the same inkjet ink.

In an exemplary calibration process few numbers of settings can be defined for coarse, medium, and high resolution to provide the user with choice of quality-speed alternative. After storing the calibrated values, a decision is made 360 whether additional setting is needed. If yes the process return to act 320 for calibrating the RIP/Inkjet printer to the next pair of resolution. If 360 there are no more pairs, the calibration process is terminated 362 and the Inkjet printer is ready to be used for imaging similar printing plates. Process 300 can be repeated each time a new type of printing plate with hydrophilic top coating is introduced, or each time a new type of water-based-pigment inkjet ink is introduced, etc.

It should be appreciated by those skilled in the art that the above-mentioned process for calibrating a RIP/Inkjet printer, may be varied in many ways, including, changing the order of acts, and can be implemented on other RIP or inkjet printers and using other inkjet ink.

We found that when the inkjet ink quantity per printed surface (IPS) is less than 2 nl/sq.mm poor image quality of offset printing impressions will be obtained, because of non-complete covering of solid 100% image areas. When IPS is higher than 10 nl/sq.mm, then the image may be destroyed during printing by washing some image areas during printing on press. Table 2 below represent exemplary results, which were found in calibrating an inkjet Epson Stylus Pro 4880 printer, with a Wasatch SoftRIP SP and T5652 UltraChrome K3 cyan inkjet ink, for example and the exemplary printing member, which is described in table 1. Other values can be found for other combination of printer, RIP, ink or printing member.

TABLE 2

Ink quantity per printed surface (IPS) as function of printed resolution.

| Resolution | Drop Volume DV (pcl) | Ink Reduction IR % | IPS nl/sq.mm |
|---|---|---|---|
| 1440 × 720 dpi | 3.5 | 100 | 5.6 |
| 720 × 720 dpi | 5.9 | 100 | 4.7 |
| 1440 × 1440 dpi | 3.5 | 60 | 6.7 |
| 720 × 720 dpi | 8.2 | 100 | 6.6 |

The inkjet-imaged-printing member may pass via a pre-press treatment. The pre-press treatment can be implemented after a baking of the inkjet imaged printing member but before starting the offset press process. An exemplary pre-press treatment can include applying or wiping the surface of the imaged printing member with acidic colloidal silica solution. The pre-press treatment sensitizes the hydrophilic feature of the non-imaged areas of the inkjet-imaged printing member and delivers sharp dotes/edges and clean non-imaged areas over the printing press copies. Exemplary acidic colloidal silica solution can comprise Snowtex O and Snowtex OUP of Nissan Chemical America Corporation, USA; Ludox HAS of W. R. Grace & Co, Grace Drive, Columbia, Md., USA. The concentration of the acidic colloidal silica in water for applying (wiping) on plate may be between 1 to 20%, preferable 3-10%. The pH of the acidic colloidal silica solution is lower than 6 and preferable range of the pH can be between 2 and 5.

In some embodiments a small amount of acidic colloidal silica solution can be added to the fountain solution used in the press process. The concentration of the acidic colloidal silica solution in the fountain solution may be 0.1-1%, preferable 0.1-0.6%.

In the description and claims of the present disclosure, each of the verbs, "comprise", "include" and "have", and conjugates thereof, are used to indicate that the object or objects of the verb are not necessarily a complete listing of members, components, elements, or parts of the subject or subjects of the verb.

In this disclosure anything designated as a unit or module or component are interchangeable and may be a stand-alone unit or a specialized module. It may be modular or have modular aspects allowing it to be easily removed and replaced with another similar unit or module. Software of a logical module can be embodied on a computer readable medium such as a read/write hard disc, CDROM, Flash memory, ROM, etc. In order to execute a certain task a software program can be loaded to an appropriate processor as needed.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Many other ramification and variations are possible within the teaching of the embodiments comprising different combinations of features noted in the described embodiments.

It will be appreciated by persons skilled in the art that the present invention is not limited by what has been particularly shown and described herein above. Rather the scope of the invention is defined by the claims that follow.

We claim:

1. A method of printing, the method comprising the steps of:

providing a printing member comprising a base and a hydrophilic polymer coating thereover, the hydrophilic coating including inorganic particles therein;

imagewise applying an aqueous inkjet ink to the surface of the member with an areawise application level less than 10 nl/mm$^2$; and printing with the printing member in a wet offset process by repeatedly (a) dampening the printing member, (b) applying ink to the dampened printing member, (c) imagewise transferring the ink to a blanket to form an image thereon, and (d) transferring the image to a recording medium to form a printed image.

2. The method of claim 1, further comprising baking the printing member following the imagewise applying step and before the printing step.

3. The method of claim 1, wherein the areawise application level is between 2 and 10 nl/mm$^2$.

4. The method of claim 1, wherein (a) if one or more elements of the image are missing from the printed image, repeating the imagewise applying step at a lower areawise application level, and (b) if the printed image has an insufficient optical density, repeating the imagewise applying step at a higher areawise application level.

5. The method of claim 4, further comprising storing the areawise application level in association with an image resolution for subsequent printing jobs having the stored image resolution.

6. The method of 4, wherein repeating the imagewise applying step at a higher or lower areawise application level comprises adjusting at least one of an ink-reduction factor or a drop volume.

7. The method of claim 1, wherein the base is aluminum.

8. The method of claim 1, wherein the inorganic particles are colloidal and/or amorphous silica.

9. The method of claim 1, further comprising applying or wiping the surface of the printing member with an acidic colloidal silica solution following the imagewise applying step.

10. The method of claim 9, wherein acidic colloidal silica solution has a concentration of colloidal silica in water is in the range of 1 to 20%.

11. The method of claim 10, wherein acidic colloidal silica solution has a concentration of colloidal silica in water is in the range of 3 to 10%.

* * * * *